United States Patent [19]

Speisebecher et al.

[11] Patent Number: 4,660,743

[45] Date of Patent: Apr. 28, 1987

[54] MELT DISPENSERS

[75] Inventors: Joachim Speisebecher, Oberursel; Christian Wooge, Bad Homburg, both of Fed. Rep. of Germany

[73] Assignee: USM Corporation, Farmington, Conn.

[21] Appl. No.: 755,808

[22] Filed: Jul. 17, 1985

[30] Foreign Application Priority Data

Jul. 28, 1984 [GB] United Kingdom ..... 8419302

[51] Int. Cl.[4] ..... B05C 5/04

[52] U.S. Cl. ..... 222/146.5; 74/128; 74/160; 226/127; 226/165

[58] Field of Search ..... 222/146.5, 391; 74/128, 74/160, 162; 226/127, 166, 162, 165

[56] References Cited

U.S. PATENT DOCUMENTS

| | | | |
|---|---|---|---|
| 2,254,521 | 9/1941 | Gardner | 226/127 |
| 2,742,142 | 4/1956 | Paulsen . | |
| 3,066,341 | 4/1962 | Hancock . | |
| 3,743,142 | 7/1973 | Elliott et al. | 222/146.5 |

FOREIGN PATENT DOCUMENTS

| | | |
|---|---|---|
| 3100830 | 8/1982 | Fed. Rep. of Germany . |
| 2155953 | 5/1973 | France . |
| 2033018 | 5/1980 | United Kingdom . |

*Primary Examiner*—Joseph J. Rolla
*Assistant Examiner*—Frederick R. Handren
*Attorney, Agent, or Firm*—Thomas S. Szatkowski

[57] ABSTRACT

A hot melt glue gun is described and claimed having a rod feeding mechanism (14) comprising a trigger (50) arranged to drive clamping means to grip a rod of adhesive and to move the rod towards a melt chamber (17) of the gun. The clamping means comprises a carriage (42) movable towards and away from the melt chamber and having a shaped portion (110) to accept a rod to be fed. The clamping means also comprises, pivoted on the carriage, a clamp member having a clamping arm portion (71) for gripping the rod against the shaped portion, and a crank arm portion (70). The crank arm portion has an operating portion (49) having a convex surface (64) arranged to co-operate with pressure means (207) of pivotally mounted connecting means (52). The connecting means is positioned to be operated by the trigger. By virtue of the disposition of the pivots and the clamping arm and of the shaping of the operating portion of the crank arm, there is brought about an improved usage of triggering effort to feed the rod. The clamping arm portion is disposed and shaped to grip the rod with reduced disfiguring and distortion of the rod.

9 Claims, 9 Drawing Figures

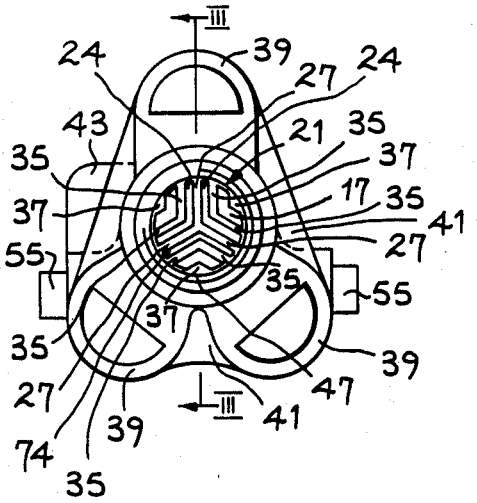
FIG_2
FIG_3
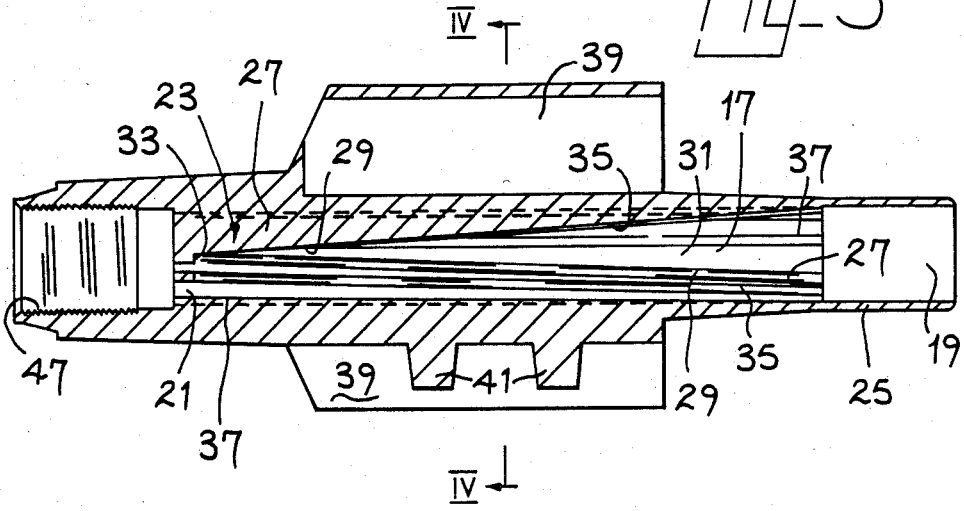
FIG_4
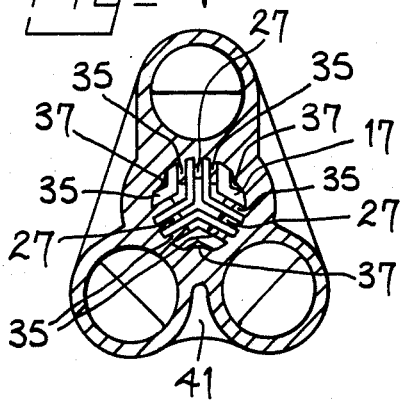

110
42
68
VI
72
71
80
64
44
63
61
49
48
70

110
42
58
79
72
79
60
60
62
62
63
48
63
44
61
44
61
70

MELT DISPENSERS

BACKGROUND OF THE INVENTION

This invention relates to melt dispensers.

Various proposals have been made to provide apparatus for melting and dispensing thermoplastic material supplied in the form of a rod. Such apparatus is usually provided with a melt body having a melt chamber in which thermoplastic material is melted, an inlet for the rod and an outlet comprising an orifice for dispensing melted material, and means for heating the melt body so that composition fed as a rod into the melt chamber may be dispensed in molten condition from the orifice. Such apparatus finds use in various fields of application, and is of particular interest in the field of applicators for hot melt adhesives and sealants and especially in hot melt glue guns having provision for feeding a rod of adhesive to the melt body, for example by trigger operated means.

The present invention is concerned with hot melt guns for melting and dispensing hot melt compositions and is more particularly concerned with a hand held glue gun comprising improved feeding means adapted to feed hot melt material in the form of a rod or stick to the melt body.

PRIOR ART

Rod feeding means employed in hand held glue guns generally includes a trigger and associated mechanism arranged to grip a rod of composition to be fed, and to advance it towards the melt chamber. It is a practice to provide an inlet sleeve of resilient material at the entrance to the melt chamber which is intended to assist in guiding the rod into the melt chamber and also to grip the surface of the rod as it is fed into the melt chamber whereby to minimise flow of melted material from the melt chamber inlet. For example, there is described in GB Patent Specification No. 1402648 a hand held hot melt glue gun having feeding means for feeding a rod of hot melt material in solid form through an inlet sleeve into a melt body, under the control of an operator, in which the feeding means comprises a carriage mounted for movement towards and away from the melt body, a clamp member pivotally mounted on the carriage and a trigger connected to the clamp member by connecting means and arranged to be operated by the operator to pivot the clamp member into engagement with the rod of hot melt supported by the carriage to grip the rod and, on further pressure on the trigger by the operator, to feed the rod into the melt chamber. The clamp member comprises a knife member by which the rod is engaged in the operation of the feeding means to feed the rod into the melt chamber.

We have found that the feeding means described in GB No. 1402648 is effective to feed rod adhesive through the inlet sleeve and into the melt chamber. However when excessive pressure is exerted on the trigger, the knife member may tend to indent or otherwise deform the rod. Disfiguration of the rod in many cases is not deleterious to efficient operation of glue guns. The problem of outflow of melted rod from the inlet of a melt chamber has been recognised previously and various means have been proposed to overcome the problem. One proposed solution involves use of an inlet sleeve of resilient material having internal lip means which are distended by passage of the rod and so grip the outer surfaces of the rod. However, severe deformation of the rod surfaces renders it impossible to rely upon the inlet sleeve to provide sufficient seal on rod entering the melt chamber to exclude the possibility of melted material being forced between the inlet sleeve and the rod.

The problems associated with disfiguration of the rod are especially relevant in relation to hand guns used for prolonged industrial use and particularly those which employ a high melt capacity melt body where there is a particular need for rapid feeding of the rod, and in those cases where the rod is unusually soft or unusually brittle.

Another disadvantage associated with available hand operated glue guns has been that a comparatively large application of effort is required to maintain the gripping of the rod whilst the carriage and clamp are moved towards the melt chamber. Not only may this accentuate the disadvantage of disfiguring the rod but also may give rise to control difficulties or operator fatigue in those cases where the glue gun is used for prolonged industrial use, especially where a substantially uniform rate of rod feed is required intermittently.

Among objects of the present invention are to provide improved rod feeding means.

BRIEF SUMMARY OF THE INVENTION

The invention provides in one of its aspects a hot melt gun comprising a melt body having a melt chamber and feeding means for feeding a rod of hot melt material in solid form, the feeding means comprising clamping means comprising a carriage mounted for sliding movement towards and away from the melt body and having a shaped portion shaped to accept a rod to be fed to the melt body, a clamp member pivotally mounted on the carriage and having a clamping arm portion disposed along the direction in which the carriage is arranged to move and a crank arm portion having an operating portion arranged to co-operate with pressure means of pivotally mounted connecting means in response to operation of a trigger of the gun whereby upon operation of the trigger the clamp member may be caused to pivot into engagement with a rod in the carriage to grip the rod against said shaped portion and on continued operation of the trigger the clamp member may be caused to move with the carriage to feed the rod towards the melt chamber, the operating portion of the crank arm having a convex surface and being so disposed that an acute angle between a plane which includes a line of contact between the convex surface and the pressure means and a plane which includes the direction in which the carriage is arranged to move is increased as the clamp member is pivoted to grip the rod whereby to increase a component of force applied in the direction in which the carriage is arranged to move.

The invention provides in another of its aspects a hot melt gun comprising a melt body having a melt chamber and feeding means for feeding a rod of hot melt material in solid form, the feeding means comprising clamping means comprising a carriage mounted for sliding movement towards and away from the melt body and having a shaped portion shaped to accept a rod to be fed to the melt body, a clamp member pivotally mounted on the carriage and having a clamping arm portion disposed along the direction in which the carriage is arranged to move and a crank arm portion having an operating portion arranged to co-operate with pressure means of pivotally mounted connecting means in response to operation of a trigger of the gun whereby upon operation of the trigger the clamp member may be caused to pivot into engagement with a rod in the carriage to grip the rod against said shaped portion and on continued operation of the trigger the clamp member may be caused to move with the carriage to feed the rod towards the melt chamber, the operating portion of the crank arm having a convex surface and being so disposed that prior to operation of the trigger means the line of contact between the convex portion and the pressure means lies to the rear (in the direction in which the carriage is arranged to move) of a plane P including the axis of rotation of the clamp member on the carriage and which is normal to the direction in which the carriage is arranged to move and that after the rod has been gripped the line of contact between the convex portion and the pressure means lies before said plane in the direction in which the carriage is arranged to move.

The invention provides in another of its aspects a hot melt gun comprising a melt body having a melt chamber and feeding means for feeding a rod of hot melt material in solid form, under the control of an operator into the melt chamber, the feeding means comprising clamping means comprising a carriage mounted for sliding movement towards and away from the melt body and having a shaped portion shaped to accept a rod to be fed to the melt body, a clamp member pivotally mounted on the carriage and a trigger connected with the clamp member by connecting means and arranged to be operated by the operator to pivot the clamp member into engagement with a rod in the carriage to grip the rod against said shaped portion and, on continued pressure on the trigger by the operator, to move the clamp member towards the melt chamber thus to feed the rod into the melt chamber, the clamp member comprising a clamping arm portion in the form of a rack providing several knife portions arranged transversely of the direction in which the carriage is arranged to move, A preferred embodiment of a glue gun according to the invention is hereinafter described by way of example to illustrate the invention. This illustrative gun comprises a melt body having a melt chamber and feeding means according to the invention for feeding a rod of hot melt material in solid form. The feeding means comprises clamping means comprising a carriage mounted for sliding movement towards and away from the melt body and having a shaped portion shaped as a curved portion to accept a rod to be fed to the melt body, and a clamp member pivotally mounted on the carriage and having a clamping arm portion disposed along the direction in which the carriage is arranged to move. The clamping arm portion is in the form of a curved element having a rod engaging surface. The rod engaging surface of the illustrative gun has several knife portions arranged transversely of the direction in which the carriage is arranged to move. The knife portions are arranged so that two or more thereof may engage the rod to grip it against the shaped portion. The clamp member also comprises a crank arm portion having an operating portion in the form of a cam lobe arranged to co-operate with a cam surface of a lever which provides pressure means of pivotally mounted connecting means in response to operation of a trigger of the gun. Upon operation of the trigger the clamp member is caused to pivot into engagement with a rod in the carriage to grip the rod against said shaped portion and on continued operation of the trigger the clamp member is caused to move with the carriage to feed the rod towards the melt chamber. The cam lobe of the crank arm has a convex surface so disposed that an acute angle between a plane which includes a line of contact between the convex surface and the cam surface and a plane which includes the direction in which the carriage is arranged to move is increased as the clamp member is pivoted to grip the rod. The cam lobe is also so disposed that prior to operation of the trigger means the line of contact between the convex surface and the cam surface lies to the rear (in the direction in which the carriage is arranged to move) of a plane including the axis of rotation of the clamp member on the carriage and which is normal to the direction in which the carriage is arranged to move and that after the rod has been gripped the line of contact between the convex portion and the pressure means lies before said plane in the direction in which the carriage is arranged to move.

In the illustrative gun, the clamp member comprises stabiliser pins located to co-operate with recesses in portions of the carriage located in front of the pivotal mounting of the clamp member (in the direction in which the carriage is arranged to move) as the carriage is moved towards the melt chamber, and to limit the extent of pivotal movement of the clamp member.

In the illustrative gun the trigger is slidably mounted in body portions of the gun and arranged to operate the connecting lever to move the clamp member to grip and feed a rod against the action of a spring. The connecting lever carries a roll 206 trapped in a curved slot, so that the pressure exerted to rotate the connecting lever is varied with increased feeding movement of the trigger.

In the illustrative gun a resilient tube is mounted at the entrance to the melt chamber which is arranged to be distended by a rod as it is fed into the melt chamber.

In the illustrative gun, a resilient mouthpiece is mounted on body portions of the gun through which rod may be supplied to the feeding means.

The body of the illustrative gun comprises two parts of tough plastics material secured together to provide a gun assembly for use in the hand of an operator.

By imparting curvature to the rod engaging surface of the clamping arm portion of a gun according to the invention it is possible to grip satisfactorily rods of various dimensions, and by arranging that two or more knife portions on the rod engaging surface of the clamping arm portion may engage the rod during gripping, substantial disfiguring of the rod may be minimised. Thus the risk that the seal between a flexible inlet tube to the melt chamber and the rod may be rendered ineffective to prevent blowback of melted material from the melt chamber under pressure of advancing rod is reduced. Also, due to the shape of a cam surface of the crank arm portion, and its disposition with respect to the direction in which the carriage is arranged to move and with respect to the axis about which the clamp member is arranged to pivot, the effort applied to the trigger during a feeding stroke of the carriage is applied (after initial gripping has been accomplished) primarily in the direction in which the carriage is arranged to move. Preferably the axis about which the clamp member is arranged to pivot is also arranged sufficiently close to the surface of a rod to be fed that the power transfer occurs in such a way that the clamping force for the rod is not directly effected by pressure on the trigger but rather by self clamping i.e. with increasing self clamping with increasing trigger force. In this way, excessive disfiguration of the rod is avoided, and the effort required to effect feeding of the rod is applied principally to movement of the carriage with consequent possibility for convenient operation and improved trigger control.

Thus, a gun having feeding means according to the invention can be used with advantage to feed rods of material to a melting chamber of high capacity in a rapid and reliable manner without severely disfiguring the surface of the rod. This is of considerable importance in relation to hand held glue guns where the strength of triggering is variable from operator to operator and may be extremely large and in relation to hot melt guns which are required to accept rods of various hardness and considerable size tolerances.

There now follows a description to be read with the accompanying drawings of the illustrative gun. It is to be clearly understood that this gun has been selected for description by way of example to illustrate the invention and is not by way of limitation thereof.

BRIEF DESCRIPTION OF THE DRAWINGS

In the drawings:

FIG. 2 is an end view of the melt body shown in FIG. 1 viewed from an outlet end of the melt body;

FIG. 3 is a view in section of the melt body indicated in FIG. 1, taken on the line III—III of FIG. 2 and viewed in the direction of the arrows;

FIG. 4 is a view in section of the melt body, taken on the line IV—IV of FIG. 3 and viewed in the direction of the arrows;

DESCRIPTION OF THE PREFERRED EMBODIMENT

Figure 1:
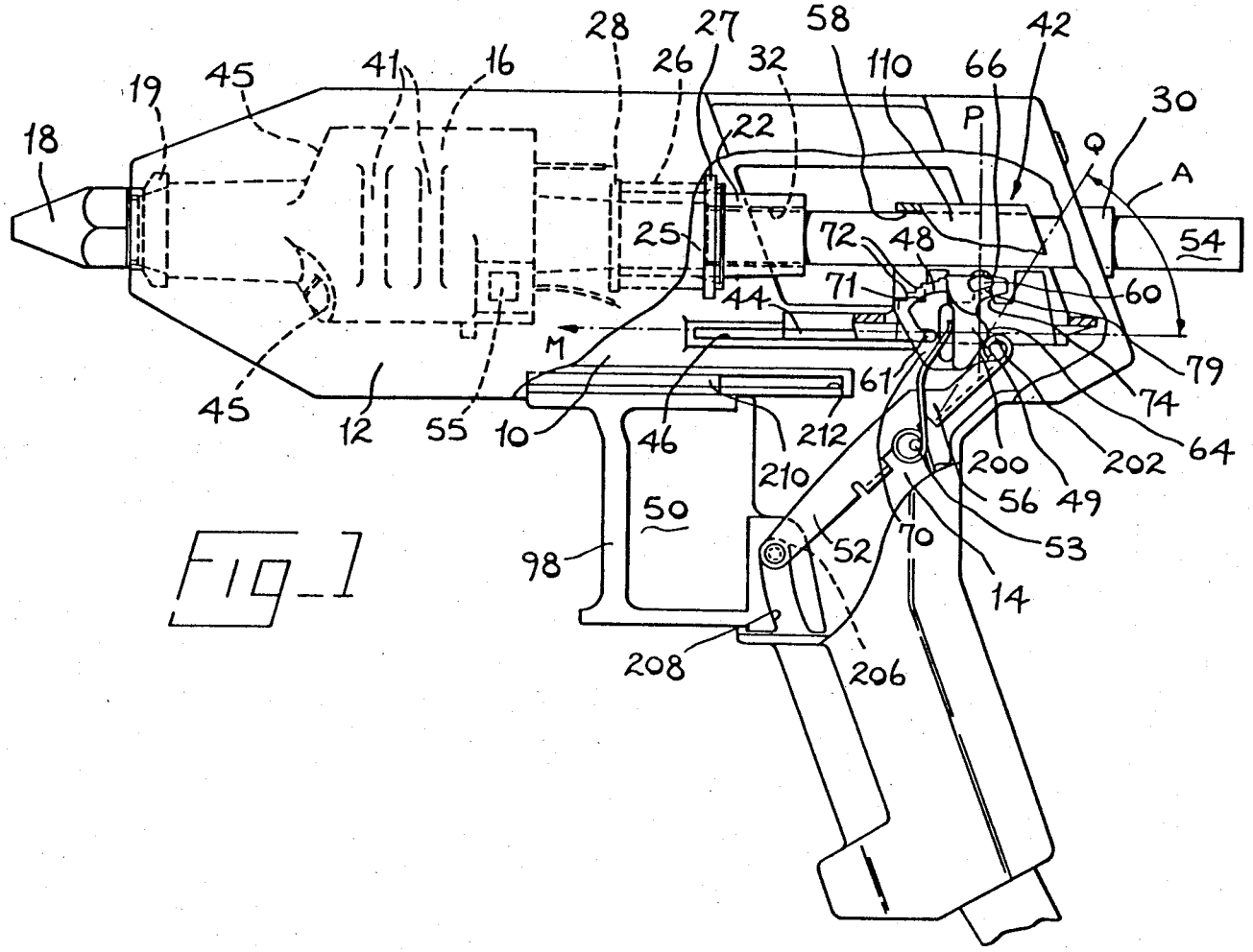
FIG. 1 is a side view of the illustrative apparatus with some parts broken away and others in section showing a rod of hot melt adhesive about to be fed to a melt body of the apparatus.
Figure 5:
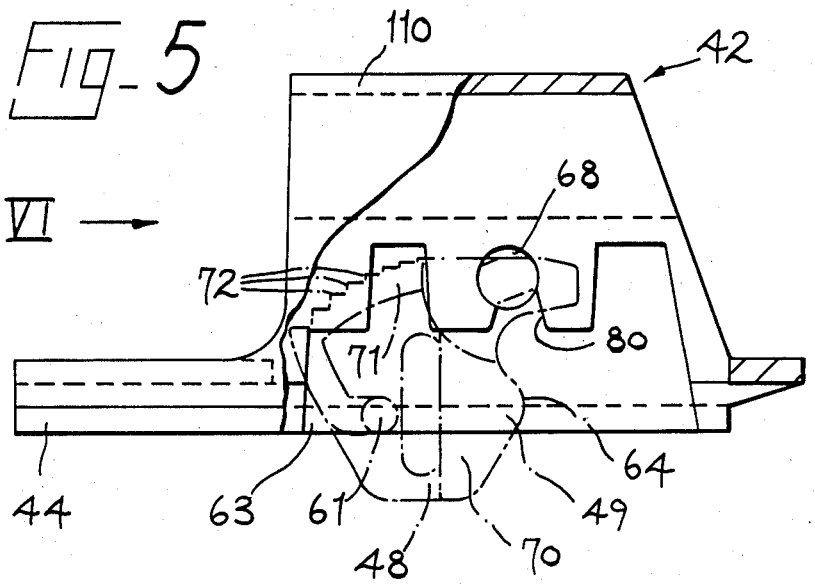
FIG. 5 is a view of a carriage of clamping means of the illustrative gun showing a clamp member in chain dotted lines in position prior to a feed stroke of the clamping means.

The illustrative gun is intended for use with rods of composition of circular cross-section and comprises a gun body having two parts 10, 12; the part 12 of the body is broken away in FIG. 1 to show feeding means 14, and other parts of the illustrative apparatus. As well as the feeding means the glue gun has a melt body 16 containing a melt chamber 17, electrically operated heating means for heating the melt body, and a nozzle 18 through which molten hot melt is expelled from the melt chamber.

The melt body. 16 is of a heat conductive alloy and is formed with a generally cylindrical melt chamber 17 (FIGS. 2, 3 and 4) in which solid composition fed to the chamber as a rod may be melted. The chamber has a circular inlet 19 through which rod enters the chamber, and an outlet 21 from which melted composition may be dispensed. Fin elements 23 are disposed lengthwise within the chamber and extend from a location adjacent the inlet to the outlet. The fin elements 23 protrude from a wall surface of the chamber into a cavity of the melt chamber and extend in directions parallel to the axis of the melt chamber and increase in size towards the outlet. The fin elements comprise major fin elements 27 and sub elements 35 each of which fin elements has a plate like structure having a substantially triangular configuration (see FIGS. 3 and 4). The fin elements comprise three major elements 27 of similar shape and size spatially disposed with angles of at least substantially 120° between adjacent major elements and which have portions of their larger ends joined together at the outlet 21. As can be appreciated the major elements 27 are arranged as a tripod within the melt chamber which is effective at least towards the outlet 21 of the melt chamber to separate the melt chamber into three sub-chambers and so that inner edge surfaces 29 of the major elements provide surface portions of a substantially pyramid shaped opening 31 centrally disposed in the chamber and which narrows to a peak 33 located adjacent the outlet 21. The fin elements also comprise six sub elements 35 disposed in pairs at 120° to each other between adjacent major elements, which also have their larger ends joined together at the outlet 21. Each sub element is disposed parallel to the adjacent major element. Inner edge surfaces of the sub elements 35 also provide surface portions of the substantially pyramid shaped opening 31. The fin elements also comprise singular elements 37 disposed on the wall surface of the melt chamber equidistant from adjacent major elements. The singular elements are substantially triangular in both the widthwise and lengthwise direction and increase in size progressively towards the outlet 21. The joints between the major elements 27 and between the sub elements 35 extend over a comparatively short length of the melt chamber, thus to provide a short outlet 21 having a series of exit slots 24 (see FIG. 2) bounded by the fin elements and disposed about the axis of the melt chamber. As can be seen from the drawings, the slots are arranged about the axis of the melt chamber and about the axis of the pyramid opening, and there is no exit slot located on the axis of the melt chamber.

The melt body comprises three housings 39 each having a bore having an axis parallel to the axis of the melt chamber for receiving electrically operated heating means in the form of cylindrical self regulating heaters 45 (FIG. 1) comprising PTC resistors distributed about the chamber. The heaters 45 are of a kind substantially as described in GB Patent Specification No. 1540482 and are constructed and arranged so that the melt body may be heated to a maximum temperature of about 225° C. Suitable uniform distribution of the heaters is achieved in the melt body shown together with desirable slim characteristics of the melt body. Webs 41 and 43 formed between pairs of the housings serve to strengthen the melt body. Locating bosses 55 (FIG. 2) formed on the melt body co-operate with sockets formed in the body parts 10 and 12.

The melt body has a threaded bore 47 coaxial with the melt chamber into which the nozzle 18 is threaded. The nozzle member contains a spring loaded ball valve (not shown) which is arranged to be opened by pressure of melted material when rod is fed into the melt chamber.

An outer surface of the melt body at the inlet is formed to provide a tube 25 onto which a flexible inlet tube 22 is secured (FIG. 1). The inlet tube 22 is formed from resilient heat resistant material and has a flange 28 at its forward end and is maintained in place on the tube by a bell shaped sleeve 26. The inlet tube 22 has an inlet passage coaxial with the melt chamber in the melt body through which a rod 54 of hot melt material, for example an adhesive or sealant, may be introduced into the inlet end of the melt chamber. The inlet tube 22 is of circular cross section and is formed with an inner lip portion 32, so that as well as guiding the rod of hot melt into the melt chamber, the tube forms a seal with the surface of the rod, militating against escape of molten hot melt material from the inlet when the rod is fed into the chamber.

A locating ring 19 of resilient heat resistant material encircles a forward portion of the melt body adjacent the nozzle and is received in co-operating recesses formed in the body portions 10 and 12. The sleeve 26 is formed with a locating ring 27 which is received in co-operating grooves formed in the body portions 10 and 12. The melt body is thus mounted in the body portions 10 and 12 at its outlet and inlet ends by means of the rings 19 and 27 and at a mid-portion by means of the bosses 55.

A resilient mouthpiece in the form of a guide collar 30 is mounted in the body of the gun at the rear and has a guide opening therethrough coaxial with the melt chamber to guide a rod of hot melt and maintain the rod properly aligned with the melt chamber as it is supplied to the feeding means. The inlet tube 22, guide collar 30 and ring 19 are conveniently made of silicone rubber.

The parts 10, 12 of the gun body are moulded of tough plastics material. The two parts 10, 12 of the body are secured together by fastenings included screws (not shown).

The feeding means 14 (FIGS. 1 and 5 to 9) of the illustrative gun comprises clamping means comprising a carriage 42, mounted for sliding movement towards and away from the melt body 16, by means of flanges 44 which engage in slideways 46, moulded in the gun body parts 10, 12 parallel with the axis of the melt chamber. It will be apparent that the carriage is thus arranged to move in a direction M defined by the flanges 44 and slideways 46 parallel to the axis of the melt chamber. The feeding means 14, further comprises a clamp member 48, pivotally mounted on the carriage 42, and a trigger 50 for actuating the clamp member 48 via a lever 52.

The carriage 42 comprises an upstanding part 110 having a guide aperture 58 through which the rod 54 passes with a small clearance, as it is fed to the melt chamber. The rod is thus supported by the upstanding part 110.

The clamp member 48 has a clamping arm portion 71, extending generally in the direction of rod feed by which the rod may be engaged in the operation of the feeding means to feed the rod into the melt chamber. In order that the clamp member may adequately grip the rod without unduly indenting the rod as it is fed even under substantial triggering and despite variations in diameter of the rod, and thus to minimise the risk that the seal between the flexible inlet sleeve 22 and the rod may be rendered ineffective to prevent blow back of melted material from the melt chamber under pressure of advancing rod, a rod engaging surface of the clamping arm portion has a somewhat arcuate configuration. The surface is serrated in order to enhance gripping of the rod, the serrations taking the form of several knife portions 72 disposed transversely of the direction of rod feed. These are arranged so that one or more and preferably not less than two may engage the rod during feeding. The rod engaging surface is located so that on operation of the trigger at least two of its knife portions are swung into contact with the rod, even though the rod may be under or oversized compared with standard diameter rod.

The clamp member 48 is provided by a casting having trunnion pins 60, by which the clamp member is pivotally mounted in the carriage 42, and stabiliser pins 61 located for movement heightwise in guideways 63 in the carriage to an extent limited by slot surfaces of the guideways. The trunnion pins are located at an upper, rearward portion of the clamp member 48. The clamp member is provided with a crank arm 70 having an operating portion in the form of a cam lobe 49 having a convex curved surface 64 located below the trunnion pins as viewed in FIGS. 1, 5, 7, 8 and 9, and disposed so that when the feed mechanism is in its rest position as shown in FIG. 1, the curved surface 64 is rearward (considered in the direction of rod feed) of a plane P normal to the direction of rod feed and extending through centre lines of the trunnion pins.

The lever 52 is mounted on a peg 53 formed in the part 10 of the gun body for pivotal movement about the peg. An upper end portion of the lever is formed as a cylindrical cam surface 202 arranged to provide pressure means to co-operate with the cam lobe 49. A lower end portion of the lever is provided with a roller bearing 206 received in a curved slot 208 formed in a rearward portion of the trigger 50 arranged so that pressure exerted to rotate the connecting lever 52 is varied with increased travel of the trigger during a feeding movement. In the rest position shown in FIG. 1, an angle A between a plane Q which includes the line of contact between the curved surface 64 and the cam surface 202 and a plane which includes the direction M in which the carriage is arranged to move, is acute as can be seen from FIG. 1.

The trigger 50 is formed with flanges 210 received in slideways 212 formed in the body parts 10, 12. The trigger and lever are so arranged as to facilitate entry of the roller bearing 206 into the open end of the slot 208 during assembly without risk of disassembly when the apparatus is in use. The trigger 50 is moulded of a hard tough plastics material. The trigger 50 has a pressure plate 98 arranged to be contacted by the finger of an operator to operate the trigger 50. The extent of movement of the trigger is restricted by engagement of the pressure plate 98 with the gun body and by engagement of a stop member also moulded integrally with the trigger 50, with the parts 10, 12 of the gun body.

The trigger 50 is arranged to be operated by the operator to pivot the clamp member 48 about the trunnion pins 60 to bring knife portions 72 into engagement with the rod 54 of solid hot melt material supported by the carriage 42, inlet sleeve 22, and guide collar 30 to grip the rod 54 and, on further pressure on the trigger 50 by the operator, to feed the rod 54 into the melt chamber.

Figure 7:
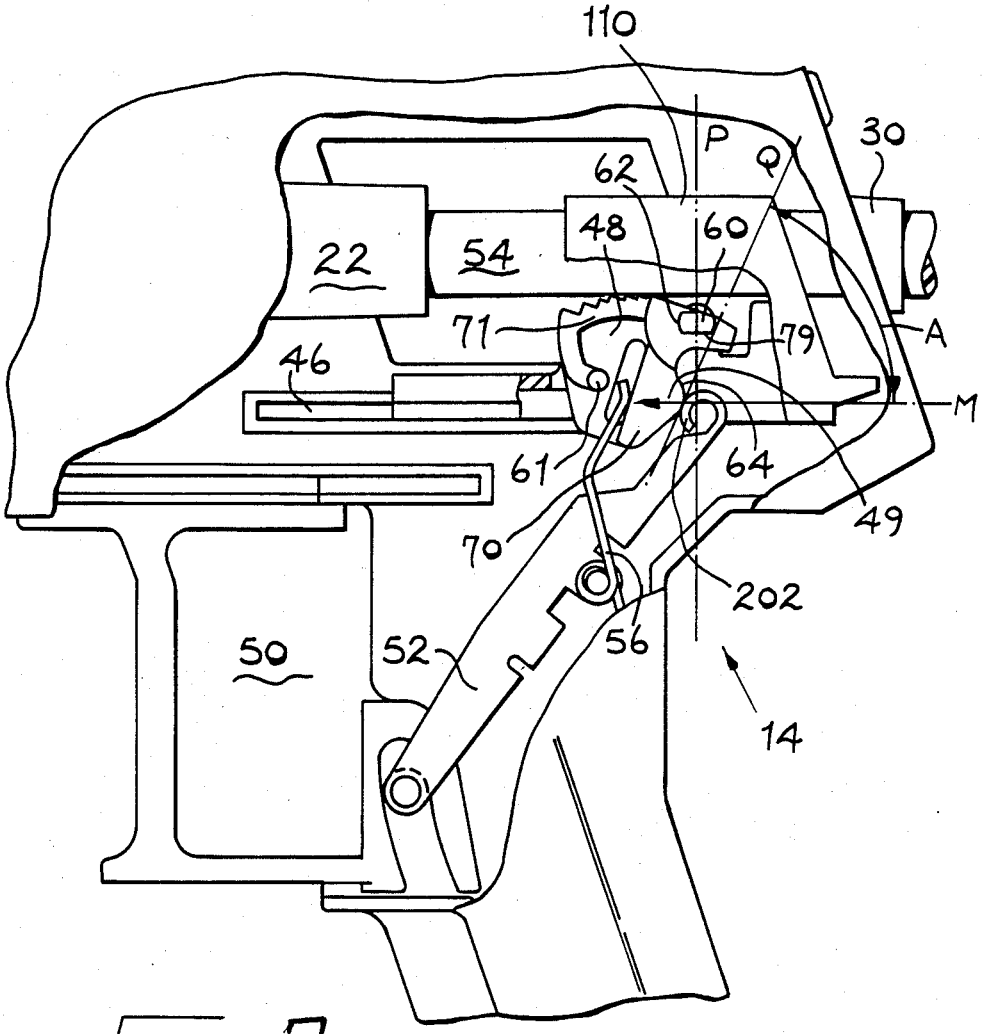
FIG. 7 is a view of feeding means of the illustrative gun with some parts broken away showing parts in positions occupied prior to a feeding stroke to feed rod to a melt chamber of the gun.
Figure 8:
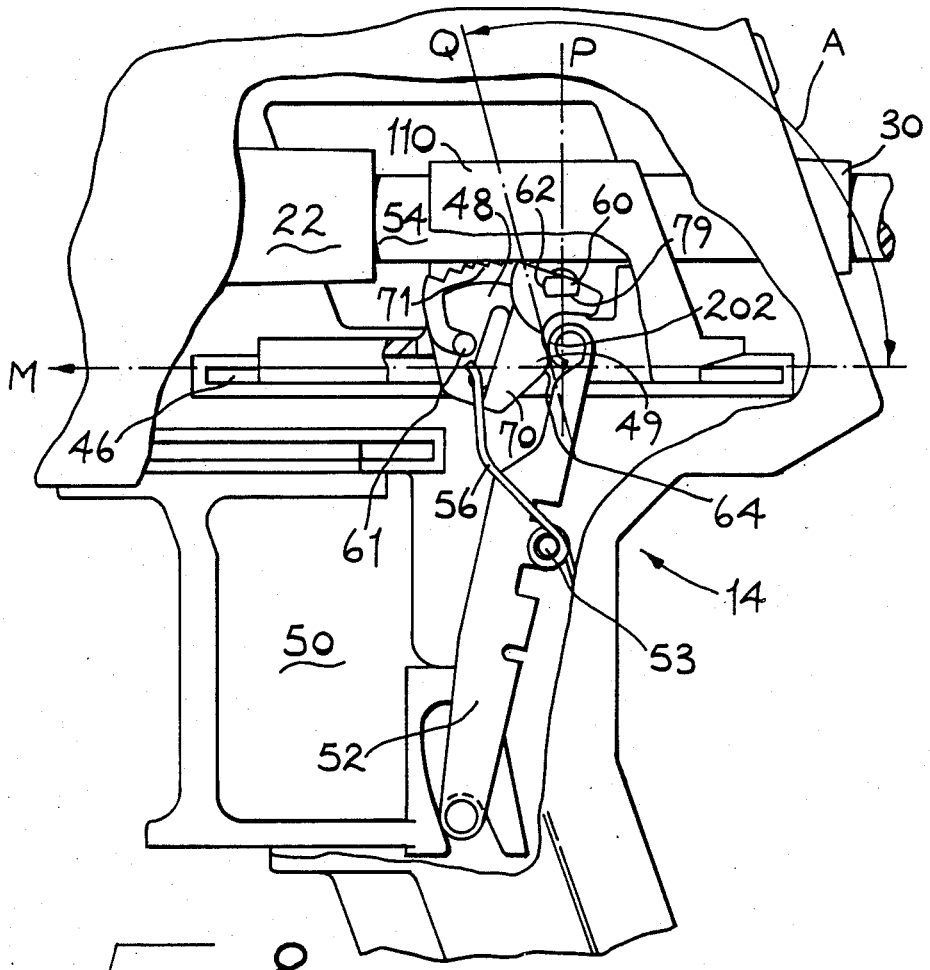
FIGS. 8 and 9 are views of the feeding means similar to FIG. 7 but showing parts in positions occupied partway through a feeding stroke and at the end of a feeding stroke respectively.
Figure 9:
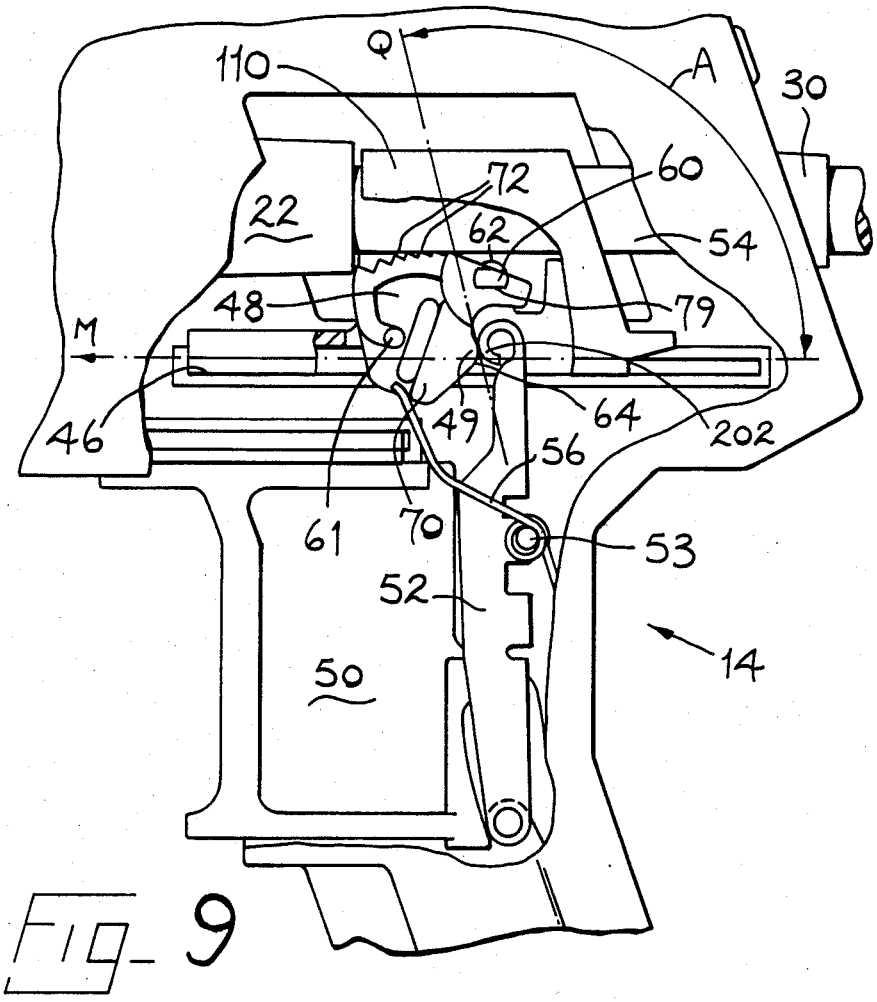

Viewing FIG. 1, when the trigger is moved rearwardly, the lever 52 is caused to rotate in a counter clockwise direction about the peg 53. The cam surface 202 is thus caused to move in an arc towards the melt body and to press upon the cam lobe 49. Initial pressure causes the clamp member to rotate clockwise about the axis of the trunnion pins 60, to an extent limited by engagement of knife portions 72 against the rod. Continued pressure causes the rod to become gripped between the knife portions and the upstanding part 110. During clockwise rotation of the clamp member the disposition of the cam lobe 49 is altered not only in relation to the cam surface 202 but also in relation to the plane P inasmuch as the cam surface 202 engages a portion of the curved surface higher than initially and also the curved surface 64 is moved to a location forward of the plane P (FIG. 7). Also, the angle A becomes less acute, i.e. is increased. Further movement of the cam surface 202 causes the clamp member to act on the carriage 42 to move it towards the melt body, with the rod gripped between the knife portions and the upstanding part. During this movement the cam surface rides up the cam lobe into a region where the angle A has become obtuse (see FIGS. 8 and 9) and pressure is exerted primarily in a direction to move the carriage forward in the direction of rod feed. By virtue of the disposition of the pivots and the clamping arm and of the shaping of the cam lobe, there is brought about a locking of the clamp member to the rod which is beneficial in reducing the effort needed for gripping the rod.

The feeding means 14 comprises a spring 56 extending between an elongate slot in the clamp member 48 and the lever pivot 53, by which the clamp member 48 is biased in a counter clockwise direction as viewed in FIG. 1 and the carriage 42 is biased away from the melt body 16. At the end of a feeding stroke, the trigger may be released, and the spring is effective to swing the clamp member about the pins 60 to lower the clamping arm from the rod and return the clamp member, carriage and lever 52 to their initial positions as shown in FIG. 1 preparatory to another feed stroke.

Figure 6:
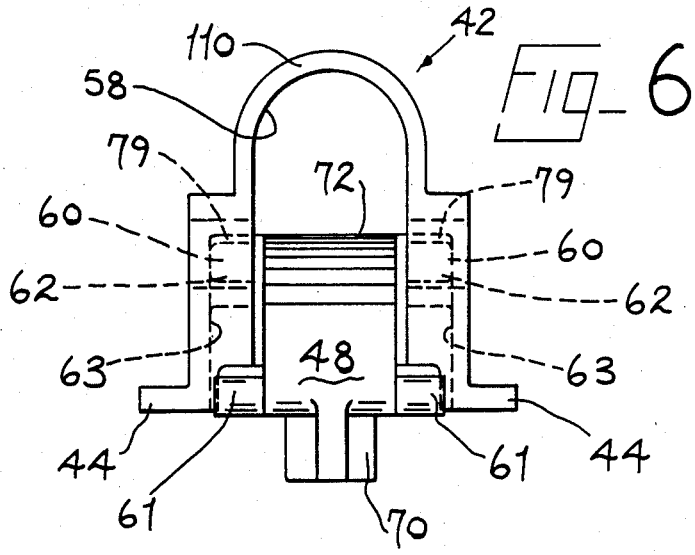
FIG. 6 is a view of the carriage and clamp member of the illustrative gun taken in the direction of the arrow VI on FIG. 5.

The feeding means 14 comprising the carriage 42, clamp member 48, lever 52, trigger 50, and spring 56 are constructed such that they can all be assembled to one another and into the parts 10, 12 of the glue gun body without further equipment or fastening means. The feeding means 14 has been designed to have as few parts as possible and to be assembled reliably and simply in such a way that when the parts 10, 12 of the gun body are secured together the feeding means remains securely assembled. Each of the trunnion pins 60 has two arcuate coaxial bearing portions 62 and two parallel flat faces 79 at opposite sides of the pin 60 (FIG. 6). The pivot pins 60 are arranged to be received in coaxial bearing openings 66 at opposite sides of the carriage 42, (FIG. 6) the bearing openings 66 being defined by circular bearing surfaces 68 against which the bearing portions 62 of the pins 60 are supported. Each of the bearing surfaces 68 has an assembly opening 80 extending around a minor arc in the surface remote from the rod 54 of hot melt supported by the carriage 42, the assembly openings 80 being sufficiently wide for the pivot pins 60 to pass through the assembly openings 80 when the flat faces 79 of the pins 60 are suitably oriented relative to the assembly opening 80 (with the flat faces 79 generally parallel to a radius of the bearing openings 66 bisecting the assembly openings 80), but when assembled in the gun, the arc of pivotal movement of the knife member 48 being restricted so that the pivot pins 60 cannot reach an orientation where the flat faces 79 are sufficiently aligned with the assembly opening 80 to permit the pins 60 to be withdrawn, or escape, through the assembly opening 80.

The feeding means 14 can be assembled simply: the trigger 50 is assembled with the lever 52, and assembled to the body part 10. The clamp member 48 is assembled with the carriage 42 by introduction of the pivot pins 60 into the bearing openings 66, and the carriage is mounted with flanges 44 in the slideways 46 of the body part 10. The spring 56 is assembled with the clamp member and the peg 53. When the feeding means 14 is assembled, the carriage 42 will be urged by the spring 56 to a rear-most position along the slideway 46 and the clamp member will be urged in a counter-clockwise direction, so that the knife portions 72 are lowered with respect to the carriage and the trigger will be urged to an outward position. The stop member will engage the part 10 of the body, preventing further clock-wise movement of the lever (viewing FIG. 1): the orientation of the knife member 48, relative to the carriage 42, is such that the pins 60 are unable to escape from the bearing opening 66 through the assembly opening 80 and likewise the lever 52 is unable to reach an orientation which would allow the bearing, 206 to escape from the slot 208. When the feeding means 14 and the other parts of the glue gun, including the melt body. 16, inlet sleeve 22, guide collar 30, electric leads and heater element, are properly assembled in the part 10 of the gun body the part 12 of the body is aligned with the part 10 and the two parts secured together.

When the trigger is moved rearwardly of the gun by pressure on the pressure plate 98, the lever 52 is caused to pivot about the peg 53 and to bring about pivotal movement of the clamp member on the carriage and sliding movement of the carriage as described above. Maximum depression of the trigger is governed by contact of the pressure plate 98 with the body parts 10, 12, in which condition the upstanding part 110 of the carriage 42 is adjacent an inlet end of the inlet tube 22. When the trigger 50 is released the knife portions are disengaged from the rod and the rod is released from the upstanding part 110 of the carriage 42. The rod 54 is restrained against movement rearwardly by the collar 30 and inlet tube 22. The carriage 42 slides rearwardly under the pressure of the spring 56 to an extent determined by engagement of the stop member with the body part 10, 12 the carriage sliding relative to the rod 54 so that on a subsequent operation of the trigger 50 a fresh part of the rod 54 is gripped by the knife portions 72 and upstanding part 110 of the carriage 42. As the rod 54 is urged into the melt chamber by the feeding means 14, heat supplied to the melt body 16 by the heating element melts the material of the rod 54 and the molten material is dispensed through the nozzle 18 under pressure applied by the feeding means 14 to the rod 54. Relaxation of pressure on the trigger 50 stops feed of rod 54 into the melt chamber and thus molten material ceases to be dispensed through the nozzle 18.

The illustrative apparatus comprises electrical circuitry for connecting the heaters to a source of electricity.

When it is desired to use the illustrative apparatus, the circuitry is connected to an electrical power source, and a rod 54 of hot melt adhesive of circular section may be pushed into the apparatus through the guide collar 30, between the upstanding part 110 and the clamp member 48, into the inlet tube 22, where it is gripped by the distended lip 32 of the inlet tube 22, and into the inlet of the melt chamber. Operation of the trigger when material in the melt chamber is melted brings about feeding of the rod as aforesaid. As rod is fed into the melt chamber, its leading end and outer surface are first softened and melted, leaving a substantially cone-like solid residue which during continued feeding is forced onto the inner edge surfaces of the fin elements. Thus, the melt chamber walls and the fin elements transfer heat to the rod. As progressively more rod is fed into the melt chamber, it serves to force heat softened or melted material before it between the fin elements and through the slots of the outlet and ultimately from the nozzle.

We claim:

1. A hot melt gun comprising a melt body having a melt chamber and feeding means for feeding a rod of hot melt material in solid form, the feeding means comprising clamping means comprising a carriage mounted for sliding movement forwardly towards and rearwardly away from the melt body and having a shaped portion shaped to accept a rod to be fed to the melt body, a clamp member pivotally mounted on the carriage and having a clamping arm portion disposed along the direction in which the carriage is arranged to move and a crank arm portion depending from the pivotal mounting of the clamp member to the carriage, the crank arm portion having an operating portion with a rearwardly facing convex surface, connecting means pivotally mounted in the gun about a fixed axis and having a pressure means bearing against the convex surface of the operating portion, a trigger mounted in the gun and coupled to the connecting means whereby upon operation of the trigger the connecting means will cause the clamp member to pivot into engagement with a rod in the carriage to grip the rod against said shaped portion and on continued operation of the trigger the clamp member will move with the carriage to feed the rod towards the melt chamber, the operating portion of the crank arm and its convex surface being so disposed that a line of contact between the convex surface of the operating portion and the pressure means shifts upwardly along the convex surface from a downwardly facing portion thereof to an upwardly facing portion thereof as the clamp member is pivoted to grip the rod whereby to increase a component of force applied in the direction in which the carriage is arranged to move.

2. A hot melt gun comprising a melt body having a melt chamber and feeding means for feeding a rod of hot melt material in solid form, the feeding means comprising clamping means comprising a carriage mounted for sliding movement forwardly towards and rearwardly away from the melt body and having a shaped portion shaped to accept a rod to be fed to the melt body, a clamp member pivotally mounted on the carriage and having a clamping arm portion disposed along the direction in which the carriage is arranged to move and a crank arm portion depending from the pivotal mounting of the clamp member to the carriage, the crank arm portion having an operating portion with a rearwardly facing convex surface, connecting means pivotally mounted in the gun about a fixed axis and having a pressure means bearing against the convex surface of the operating portion, a trigger mounted in the gun and coupled to the connecting means whereby upon operation of the trigger the connecting means will cause the clamp member to pivot into engagement with a rod in the carriage to grip the rod against said shaped portion and on continued operation of the trigger the clamp member will move with the carriage to feed the rod towards the melt chamber, the operating portion of the crank arm and its convex surface being so disposed that prior to operation of the trigger means the line of contact between the convex surface of the operating portion and the pressure means lies rearwardly of the pivotal mounting of the clamp member on the carriage , and that after the rod has been gripped the line of contact between the convex surface and the pressure means lies forwardly of the pivotal mounting.

3. A hot melt gun according to claim 1 or claim 2 wherein the clamp member comrpises a clamping arm portion in the form of a rack providing several knife portions arranged transversely of the direction in which the carriage is arranged to move.

4. A gun according to claim 1 or claim 2 wherein the clamping arm portion is in the form of an arcuate rack having a plurality of knife portions extending transversely of the direction in which the carriage is moved and arranged so that two or more thereof may engage the rod to grip it against the shaped portion.

5. A gun according to claim 1 or 2 wherein the clamp member comprises stabiliser pins located to co-operate with recesses in portions of the carriage located in front of the pivotal mounting of the clamp member (in the direction in which the carriage is arranged to move) as the carriage is moved towards the melt chamber.

6. A gun according to claim 1 or 2 wherein the trigger is slidably mounted in body portions of the gun and arranged to operate the connecting means to move the clamp member to feed a rod to the melt chamber against the action of a spring.

7. A gun according to claim 1 or claim 2 wherein the connecting means comprises a lever pivotally mounted on body portions of the gun and formed with a cam surface providing said pressure means.

8. A gun according to claim 1 or 2 comprising a resilient tube arranged to be distended by the rod as it is fed into the melt chamber.

9. A gun according to claim 1 or 2 comprising a resilient mouthpiece through which rod may be supplied to the feeding means.

* * * * *